US007106879B2

(12) United States Patent
Yano

(10) Patent No.: US 7,106,879 B2
(45) Date of Patent: Sep. 12, 2006

(54) LOUDSPEAKER

(75) Inventor: Hiroshi Yano, Tsu (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/493,882

(22) PCT Filed: Sep. 4, 2003

(86) PCT No.: PCT/JP03/11295

§ 371 (c)(1),
(2), (4) Date: Apr. 27, 2004

(87) PCT Pub. No.: WO03/067487

PCT Pub. Date: Aug. 14, 2003

(65) Prior Publication Data

US 2004/0258271 A1 Dec. 23, 2004

(30) Foreign Application Priority Data

Feb. 7, 2002 (JP) ..... 2002-30330
Aug. 13, 2002 (JP) ..... 2002-23521
Dec. 24, 2002 (JP) ..... 2002-372687

(51) Int. Cl.
*H04R 25/00* (2006.01)

(52) U.S. Cl. ..... 381/396; 381/400; 381/412

(58) Field of Classification Search ..... 381/395–397, 381/412–414, 419–420, 422, 433
See application file for complete search history.

(56) References Cited

U.S. PATENT DOCUMENTS 2,216,961 A * 10/1940 Sanial ..... 381/420
2,532,413 A * 12/1950 Levy ..... 381/420
3,358,089 A * 12/1967 Parker ..... 381/420
5,524,151 A 6/1996 Bleim
6,724,908 B1 * 4/2004 Fukuyama ..... 381/396
6,847,139 B1 * 1/2005 Ueda et al. ..... 381/396

FOREIGN PATENT DOCUMENTS

DE 29 05 566 8/1980
JP 57-151096 9/1982
JP 4-362900 12/1992
KR 2001-0088726 9/2001

OTHER PUBLICATIONS

International Search Report corresponding to application No. PCT/JP03/11295 dated Dec. 16, 2003.

* cited by examiner

*Primary Examiner*—Suhan Ni
(74) *Attorney, Agent, or Firm*—RatnerPrestia

(57) ABSTRACT

In a loudspeaker, even if an interval between a diaphragm and a yoke is small, a lead wire, an end of the coil wire of a voice coil, moves upward and downward in and/or over a cutout portion formed in the yoke, and does not collide with the yoke. The loudspeaker does not have disadvantages, such as noises and disconnection of the end of the coil wire, and can be thin.

4 Claims, 2 Drawing Sheets

LOUDSPEAKER

This Application is a U.S. National Phase Application of PCT International Application PCT/JP2003/011295, filed Sep. 4, 2003.

TECHNICAL FIELD

The present invention relates to a loudspeaker used in a portable communication device, such as a portable telephone.

BACKGROUND ART

A loudspeaker including a yoke, magnet 103 and a magnetic circuit integrated unitarily into a frame is disclosed in Japanese Patent Laid-Open Publication No. 4-362900.

FIG. 4 is a sectional view of a conventional loudspeaker. Cylindrical yoke 101 having a bottom is made of magnetic material, such as iron. Frame 102 made of resin is fixed at an outer periphery of yoke 101 by being inserted with pressure or molding. Magnet 103 is spaced from inner surface 101*a* of a side wall of yoke 101 by a predetermined interval and is bonded to the bottom of yoke 101. Plate 104 is bonded on an upper surface of magnet 103 and provides magnetic gap 104*a* between the plate and inner surface 101*a* of yoke 101. Diaphragm 105 is formed by molding a resin sheet. Voice coil 106 is positioned in magnetic gap 104*a* and has an end bonded on a lower surface of diaphragm 105.

Voice coil 106 is formed by winding a coil wire having a heat welding layer on its surface and coated for insulating and heating the wound wire. Coil terminals 106*a*, both end portions of voice coil 106, are led from between diaphragm 105 and yoke 101, and connected by soldering to respective ends of external terminals 107 integrated with frame 102.

In the structure mentioned above, a sound signal is supplied from an external sound source through external terminals 107 to voice coil 106, and the voice coil 106 and diaphragm 105 vibrate to generate a sound.

The conventional loudspeaker is to be thin and make a large output for use in a portable communication device, such as a portable telephone, and coil terminals 106*a* led from between diaphragm 105 and yoke 101 may contact diaphragm 105 or yoke 101 according to a vibration of the loudspeaker driven, thereby producing a noise. The conventional loudspeaker accordingly requires a certain interval between diaphragm 105 and yoke 101, thus being prevented from having a reduced size.

SUMMARY OF THE INVENTION

A loudspeaker includes a yoke, a magnet, a plate, a frame, a diaphragm, a voice coil, and an external terminal. The yoke has a tube shape having a bottom and a side wall having a first cutout portion formed therein. The magnet is spaced from the side wall of the yoke by a predetermined interval and provided on the bottom of the yoke. The plate is provided on the magnet and provides a magnetic gap between the plate and an inner surface of the side wall. The frame provided at an outer periphery of the yoke. The diaphragm has an edge thereof coupled to the frame. The voice coil is formed by winding a coil wire in the magnetic gap, and has an edge thereof coupled to the diaphragm. The external terminal is provided at the frame and connected to an end portion of the coil wire led from the voice coil. The first cutout portion is provided at a position corresponding to the end portion of the coil wire.

The loudspeaker can be thin since an interval between the diaphragm and the yoke can be short.

DETAILED DESCRIPTION OF PREFERRED EMBODIMENT

Figure 1:
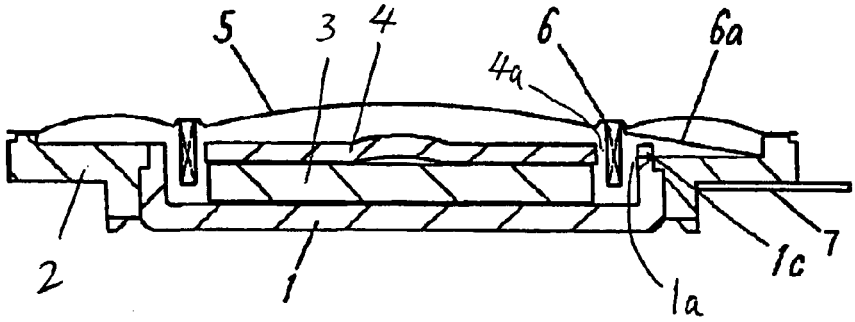
FIG. 1 is a sectional view of a loudspeaker in accordance with an exemplary embodiment of the present invention.
Figure 2:
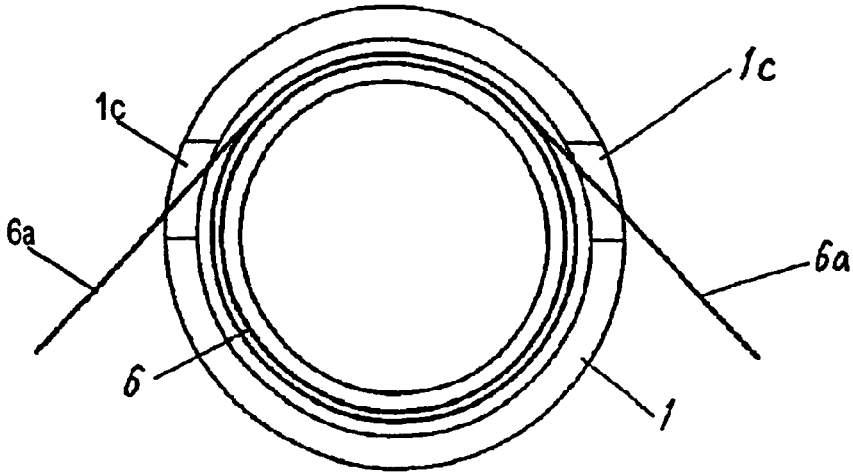
FIG. 2 is a top view of a voice coil and a yoke of the loudspeaker in accordance with the embodiment.

FIG. 1 is a sectional view of a loudspeaker in accordance with an exemplary embodiment of the present invention. FIG. 2 is a top view of a voice coil and a yoke, essential parts of the loudspeaker.

As shown in FIG. 1, cylindrical yoke 1 having a bottom is made of magnetic material, such as iron. Frame 2 made of resin is fixed at an outer periphery of yoke 1 by being inserted with pressure process or molding. Magnet 3 is spaced from inner surface 1*a* of a side wall of yoke 1 by a predetermined interval and is bonded on the bottom of yoke 1. Plate 4 is bonded on an upper surface of magnet 3 and forms magnetic gap 4*a* between the plate and inner surface 1*a* of yoke 1. Diaphragm 5 is formed by molding a resin sheet. Voice coil 6 is positioned in magnetic gap 4*a* and has an end bonded on a lower surface of diaphragm 5.

Voice coil 6 has an edge bonded on the lower surface of diaphragm 5, and has the other edge positioned in magnetic gap 4*a*. Voice coil 6 is formed by winding a coil wire having a heat welding layer on its surface and coated for insulating and heating the wound wire.

Lead wires 6*a*, both ends of the coil wire of voice coil 6, are led from the wound coil wire in a direction tangential to the wound coil wire through between diaphragm 5 and yoke 1, and electrically coupled with external terminals 7 at frame 2 by soldering.

According to the embodiment, a cylindrical wall of yoke 1 has cutout portions 1*c* formed under portions around lead wires 6*a*, the ends of the coil wire of voice coil 6, led from the wound coil wire in a direction tangential to the wound coil wire. In other words, cutout portions 1*c* are formed at positions corresponding to lead wires 6*a*, the ends of the coil wire.

Lead wires 6*a*, the ends of the coil wire, move in and over cutout portions 1*c* when lead wires 6*a* vibrates upward and down ward during driving of the loudspeaker. Therefore, even if an interval between diaphragm 5 and yoke 1 is short, cutout portions 1*c* maintains an interval between yoke 1 and lead wire 6*a*, an end of the coil wire, thus allowing the loudspeaker to be thin.

Figure 3:
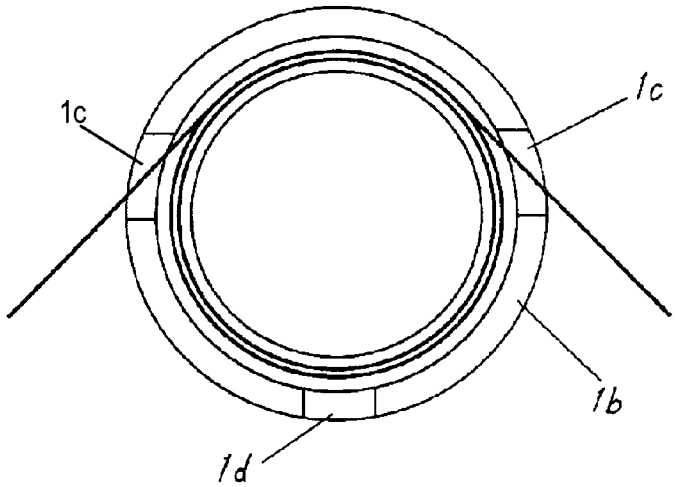
FIG. 3 is a top view of the voice coil and another yoke of a loudspeaker in accordance with the embodiment.
Figure 4:
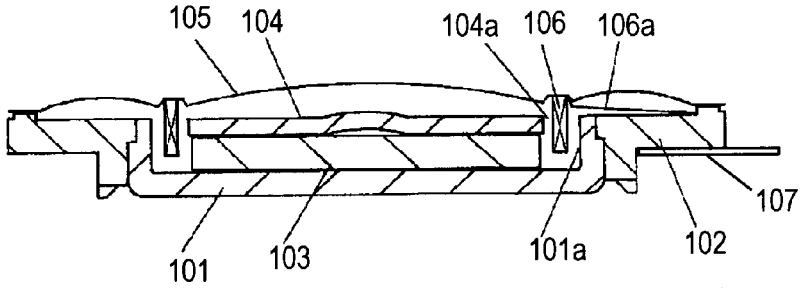
Fig. 4 PRIOR ART
FIG. 4 is a sectional view of a conventional loudspeaker.

FIG. 3 is a top view of voice coil 6 and another yoke 1*b* of a loudspeaker in accordance with the embodiment. Yoke 1*b* further has cutout portion 1*d* formed therein.

Cutout portions 1*c* reduce a magnetic flux passing through voice coil 6 and may unbalance the magnetic flux. In case that cutout portions 1*c* is large and that an unbalanced portion of the magnetic flux is large, diaphragm 5 may roll according to its vibration and collide with yoke 1, thereby generating a noise. In the worst case, a problem that diaphragm 5 is broken may occur.

Cutout portion 1*d* reduces the magnetic flux partially as well as cutout portions 1*c*. Portion 1*d* cancels the unbalance of the magnetic flux in yoke 1*b*, hence eliminating the problem.

In the loudspeaker according to the embodiment, yokes 1 and 1*b* have cylindrical shapes, and however, may have other shapes, such as quadrilateral shapes.

In addition, lead wires 6*a* of voice coil 6 are placed over cutout portions 1*c* in FIG. 2, respectively. One of lead wires 6*a* may be placed over cutout portion 1*c*, and the other lead wire 6*a* may be led via another path.

INDUSTRIAL APPLICABILITY

A loudspeaker according to the present invention has a cutout portion formed in a position of a yoke corresponding to a lead wire, an end of a coil wire, led from a voice coil, hence having a thin shape.

The invention claimed is:

1. A loudspeaker comprising:

a yoke having a tube shape having a bottom and a side wall, the side wall having a first cutout portion forming a notch in the sidewall;

a magnet spaced from the side wall of the yoke by a predetermined interval and provided on the bottom of the yoke;

a plate provided on the magnet, the plate providing a magnetic gap between the plate and an inner surface of the side wall;

a frame provided at an outer periphery of the yoke, the frame having a top surface;

a diaphragm having an edge thereof coupled to the frame;

a voice coil formed by winding a coil wire in the magnetic gap, the voice coil having an edge thereof coupled to the diaphragm; and an external terminal provided at the frame, wherein the voice coil has an end portion which extends over the top surface of the frame, the end portion of the voice coil being connected to the external terminal via the top surface of the frame, and wherein the first cutout portion is provided at a position corresponding to the end portion of the coil wire.

2. The loudspeaker of claim 1, wherein the end portion of the coil wire extends in a direction tangential to the voice coil.

3. The loudspeaker of claim 1, wherein the side wall of the yoke has a second cutout portion forming a further notch in the sidewall.

4. The loudspeaker of claim 3, wherein the second cutout portion is operable to cancel an unbalance of a magnetic flux between the yoke and the plate, the unbalance caused by the first cutout portion.

* * * * *

UNITED STATES PATENT AND TRADEMARK OFFICE

CERTIFICATE OF CORRECTION

PATENT NO. : 7,106,879 B2
APPLICATION NO. : 10/493882
DATED : September 12, 2006
INVENTOR(S) : Hiroshi Yano It is certified that error appears in the above-identified patent and that said Letters Patent is hereby corrected as shown below:

Title Page, (87) PCT Pub. No.
DELETE "WO03/067487"
ADD -- WO/2004/023842 --

Title Page, (87) PCT Pub. Date
DELETE "Aug. 14, 2003"
ADD -- March 18, 2004 --

Title Page, (30) FOREIGN APPLICATION PRIORITY DATA
DELETE
"Feb. 7, 2002 (JP) .....2002-30330
Aug. 13, 2002 (JP) .....2002-23521
Dec. 24, 2002 (JP) .....2002-372687"

Title Page, (30) FOREIGN APPLICATION PRIORITY DATA
ADD
-- September 4, 2002 (JP) ..... 2002-258526 --

Signed and Sealed this

Seventeenth Day of April, 2007

JON W. DUDAS
*Director of the United States Patent and Trademark Office*